United States Patent [19]

Cole

[11] Patent Number: 4,589,864

[45] Date of Patent: May 20, 1986

[54] CENTRIFUGE ROTOR HAVING A RESILIENT TRUNNION

[75] Inventor: Paul M. Cole, Wilmington, Del.

[73] Assignee: E. I. Du Pont de Nemours and Company, Wilmington, Del.

[21] Appl. No.: 668,420

[22] Filed: Nov. 5, 1984

[51] Int. Cl.[4] ..... B04B 5/02

[52] U.S. Cl. ..... 494/20

[58] Field of Search ..... 494/16, 20, 17, 18; 422/72

[56] References Cited

U.S. PATENT DOCUMENTS

| | | | |
|---|---|---|---|
| 3,752,390 | 8/1973 | Chulay . | |
| 3,877,634 | 4/1975 | Rohde | 494/20 |
| 4,190,195 | 2/1980 | Chulay . | |
| 4,254,905 | 3/1981 | Baumler | 494/20 |
| 4,344,563 | 8/1982 | Romanauskas . | |
| 4,400,166 | 8/1983 | Chulay et al. . | |
| 4,431,423 | 2/1984 | Weyant | 494/20 |

*Primary Examiner*—Robert W. Jenkins

[57] ABSTRACT

A centrifuge rotor is provided in which an array of loops is circumferentially provided about the exterior of the hub. The loops have openings therein which receive a hook-like appurtenance mounted on a sample container and support the same for pivotal rotation from first to second position. The loops are resiliently mounted to the hub such that increased centrifugal force is accommodated by radially outward deflection of loops. The loops may be torsioned to untwist as the carrier pivots from the first to the second position.

38 Claims, 7 Drawing Figures

Fig. 6.
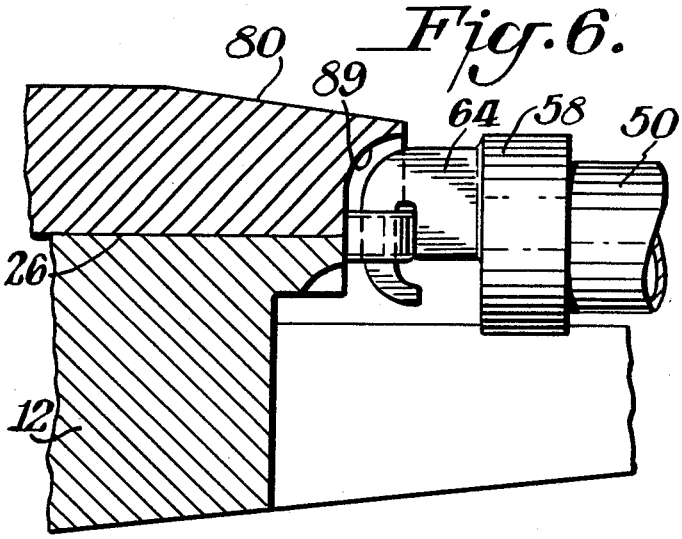
Fig. 7.
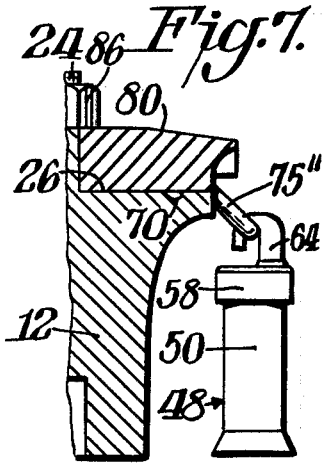
Fig. 4.
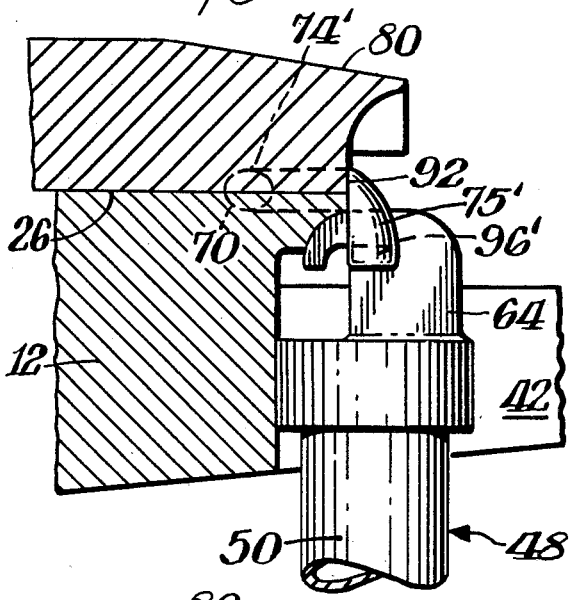
Fig. 5.
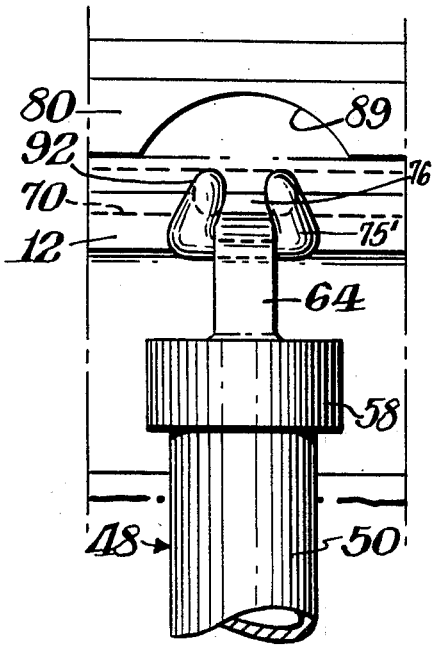
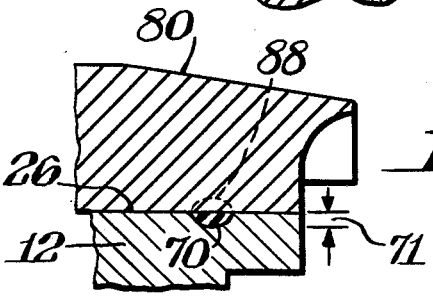
Fig. 3.

CENTRIFUGE ROTOR HAVING A RESILIENT TRUNNION

FIELD OF THE INVENTION

The invention relates to a swinging bucket centrifuge rotor and, in particular, to a swinging bucket centrifuge rotor in which the trunnions which support the pivotal movement of the sample carrier are defined by a looped member preferably formed from a resilient fiber material.

DESCRIPTION OF THE PRIOR ART

A centrifuge rotor of the type of which a sample container carrying a sample of the material to be centrifuged moves from an initial position in which the axis of the sample container is substantially parallel to the vertical center line of the rotor to a second position in which the axis of the sample container lies substantially in a plane perpendicular to the vertical center line of the rotor is known as a swinging bucket rotor. Either of the sample container used with such rotors or the container support arms typically includes outwardly projecting elements, or trunnion pins, having a portion thereof defining a substantially cylindrical bearing surface. The trunnion pins are typically received in corresponding conforming trunnion receiving sockets that are provided in the other of the container or arm. Exemplary of such swinging bucket rotors is that shown in U.S. Pat. No. 4,344,563 (Romanauskas) assigned to the assignee of the present invention.

For relatively high speed centrifugation (above twenty thousand revolutions per minute) devices known as ultracentrifuges are used. The rotor for such an ultracentrifuge instrument uses a container pivoting arrangement which includes a hanger flexibly mounted to the rotor body. The hanger terminates in rod-like trunnions which are adapted to receive a hook-like appurtenance which is formed (typically integrally) at the upper end of the sample container. Exemplary of such pivoting arrangements are those shown in U.S. Pat. No. 3,752,390 (Chulay) and U.S. Pat. No. 4,190,195 (Chulay et al.). U.S. Pat. No. 4,400,166 (Chulay et al.) relates to a modified container in which the upper end thereof is provided with a transversely extending opening through which a trunnion bar extends. The bar is received at its extremities in vertically disposed guideways provided in the body of the rotor.

In whatever form utilized trunnion-based elements which support the pivoting motion of the sample container from the first to the second position are relatively complex and expensive to manufacture. Accordingly, it is believed advantageous to provide a rotor having a sample container pivoting support arrangement which eliminates the relatively high cost and complexity attendent upon the pivot support trunnion systems of the prior art.

SUMMARY OF THE INVENTION

The present invention relates to a centrifuge rotor of the swinging bucket type which supports a sample container having a hook-like appurtenance thereon for rotation from a first position in which the axis of the sample container lies substantially parallel to the axis of rotation of the rotor to a second position in which the axis of rotation of the carrier lies substantially perpendicularly thereto. In accordance with the present invention the rotor comprises a central hub connectable to a source of motive energy and, provided about the periphery of the hub, an array of circumferentially spaced looped members each having an opening therein. The opening in each of the looped members is accessible from the exterior of the hub. Each looped member is arranged to receive the hooked end of the sample container through the opening therein and is adapted to support the same during its pivotal movement from the first to the second position.

In the preferred embodiment the hub is provided with a plurality of grooves which are adapted to receive an integrally formed ring-like member preferably fabricated of a resilient material. When received within the pattern of the grooves predetermined portions of the ring project beyond the basic diameter of the hub thereby defining the looped members. Each looped member is therefore resiliently mounted to the hub such that when the sample container is in the second position increased centrifugal force occasioned by an increasing rotor speed is accommodated by radially outward deflection or stretching of the looped portions of the ring to dispose the radially outer end of the sample container into a force transmitting relationship with a stress confining enclosure mounted in a substantially concentric relationship with the hub.

In one embodiment of the invention, the looped members defined by the resilient ring relatively loosely receives the hook-like appurtenance of the end of the sample container such that relative motion occurs between the hook-like appurtenance and the looped member as the container pivots from the first to the second position.

In an alternate embodiment the hook-like appurtenance tightly engages the looped member such that relative movement therebetween is prohibited. Thus, in one case, as the container hangs from the hub and occupies the first position the looped member is twisted approximately ninety degrees. The pivotal motion of the sample container from the first to the second position is accommodated by the untwisting of the looped member. In an alternate case, in the first position the container imposes no torsion on the looped member. However, as the container pivots the looped member is twisted. In either case, in this embodiment of the invention, no relative motion occurs between the hook-like appurtenance on the sample container and the looped member.

BRIEF DESCRIPTION OF THE DRAWING

The invention may be more fully understood from the following detailed description thereof taken in connection with the accompanying drawings which form a part of this application and in which:

FIG. 3 is a section view taken along section lines 3—3 in FIG. 1 illustrating a portion of the resilient ring-like member received within the rotor hub;

FIGS. 4 and 5 are, respectively, side elevation and front elevation views of a looped member in accordance with a second embodiment of the present invention with the sample container in the first position;

FIG. 6 is a side elevation view of the looped member of FIGS. 4 and 5 with the sample container in the second position; and, FIG. 7 is a side elevation view of a modified embodiment of the invention.

DETAILED DESCRIPTION OF THE INVENTION

Figure 1:
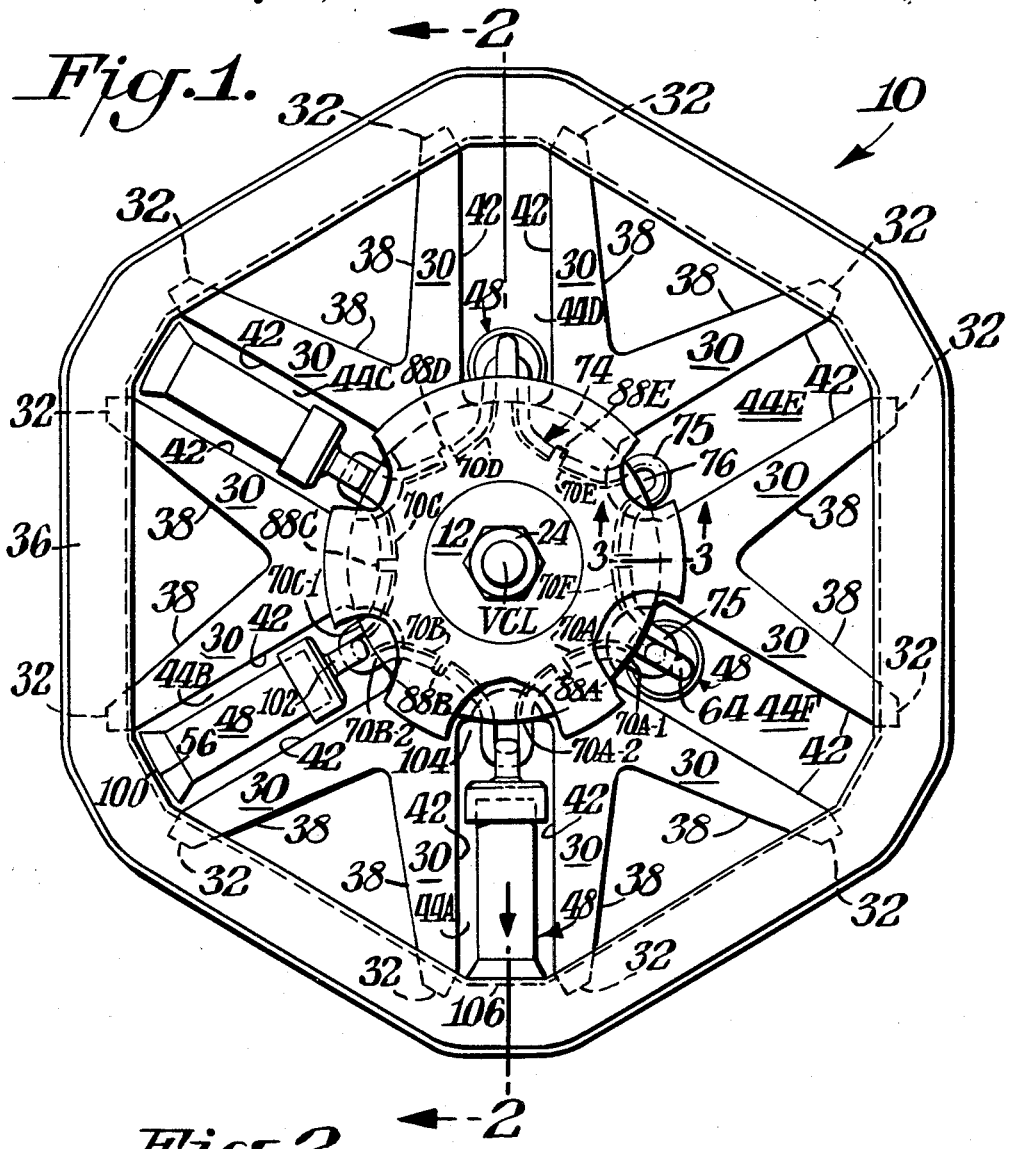
FIG. 1 is a plan view of a swinging bucket centrifuge rotor in accordance with the present invention.

Throughout the following detailed description similar reference numerals refer to similar elements in all figures of the drawings.

With reference to the figures, a centrifuge rotor generally indicated by reference character 10 in accordance with the present invention is illustrated. The rotor includes a centrally disposed hub member 12 fabricated of a suitable material such as aluminum. The hub 12 may be suitably connected, as schematically shown by the connection 18, to a source 20 of motive energy whereby the hub 12 is rotatable about a central vertical axis VCL. Of course, the hub 12 may be indirectly connected, as through an intermediate member, to the motive source 20. The hub 12 is provided with upwardly extending threaded mounting bolt 24.

The hub 12 is a substantially cylindrical member having an annular, generally horizontal, planar surface 26 provided thereon. An array of generally radially extending spokes 30 radiate outwardly from the hub 12. The radially outer end 32 of each of the spokes 30 abuts against a generally annular stress confining enclosure 36 generally concentrically arranged with respect to the hub 12. In the embodiment illustrated the enclosure 36 is formed of a wound array of high strength fiber cords impregnated with an epoxy resinous material. Suitable for use of high strength cord is the aramid fiber manufactured and sold by E. I. du Pont de Nemours and Company under the trademark KEVLAR ®. The fiber cord is wrapped to define substantially chordal lengths between the circumferentially adjacent ends 32 of the spokes 30. Alternatively, of course, any suitable stress confining enclosure formed of a composite or metallic member either with or without a surrounding fiber wrapping may be utilized and remain within the contemplation of the present invention. As also seen in the Figures, spokes 30 are arranged in pairs such that confronting surfaces 38 define a substantially V-shaped regions arranged circumferentially about the periphery of the rotor. The other surfaces 42 of each of the spokes 30 cooperate with a circumferently confronting one of the surfaces 42 to define an array of circumferentially spaced sample container receiving pockets 44.

Each pocket 44 is arranged to receive a sample container generally indicated by reference character 48 formed of a substantially tubular body member 50 having a predetermined cavity 52 of any desired shape formed on the interior thereof. The upper radially inner end of the body 50 is threaded, as at 53. The opposite radially outer end of the body 50 is flared through a frustoconical region 54 and terminates in a substantially spherical end portion 56 which, in a manner to be described, abuts in a force transmissive relationship with the inner surface of the stress confining enclosure 36. The sample container 48 further includes a cap 58 with internal threads 60 which cooperate with the external threads 53 to secure the cap 58 to the body 50. Integrally formed with the upper end of the cap 58 is a hook-like appurtenance 64 perhaps best seen in FIGS. 2 and 6.

The hub 12 is provided along the upper annular surface 26 thereof with a pattern of grooves 70 extending a predetermined axial distance 71 (FIG. 3) into the surface 26. The number of such grooves 70 corresponds to the number of sample containers 48 carried by the rotor 12. In the embodiment illustrated, since it is a six place rotor, that is, defines six pockets 44 and carries six containers 48, six grooves 70 are formed in the upper surface 26 of the hub 12. Adjacent ends of each pair of circumferentially adjacent grooves 70 communicate with a particular radially outwardly disposed pocket 44. Thus, for example, in FIG. 1, the grooves 70A and 70B each have first and second ends respectively indicated by the hyphenated numeral following the same. The adjacent ends 70A-2 of the segment 70A and 70B-1 of the segment 70B communicate with the pocket 44A. Similarly, the second end 70B-2 of the segment 70B and the first end 70C-1 of the segment 70C communicate into the pocket 44B.

In accordance with the present invention, a ring-like member 74 fabricated of resilient material is inserted into the grooves 70A through 70F such that a predetermined length of the ring 74 projects outwardly into the pockets 44 arranged circumferentially about the rotor. Preferably the ring 74 is fabricated of a resilient cable made of an elastomeric compound such as P642-70 sold by Parker-Hinnifin Corp. By "resilient" it is meant that material has the capability after being strained to recover its size and shape. The projecting portions of the ring 74 define looped members 75 having an inner opening 76 accessible from the exterior of the hub. To assist in maintaining the ring 74 within the grooves provided in the hub 12 a cover 80 formed of any suitable material is provided with a central aperture 82 which receives the projecting bolt 24 so as to bring the planar annular undersurface 84 of the hub cover 80 into vertically abutting relationship with the planar surface 26 on the hub. The cover 80 is secured to the hub 12 by the provision of a cap nut 86 threadedly engaged onto the bolt 24. The ring 74 may be clamped to the hub 12 at any predetermined distance therealong, as at clamp points, by suitable means such as projections 88 depending from the underside of the cover 80. Depending upon the relative depth 71 of the grooved segment 70 and the diametrical dimension of the ring 74 the vertically abutting contact between the hub 12 and the hub cover 80 may further serve to compress those portions of the ring trapped between these last two mentioned structural members to further assist the maintenance of the ring within the grooves 70 provided in the hub 12. The cover 80 may also be provided with grooves which register with the grooves 70. Of course, any other suitable convenient mode of attachment may be utilized. It is also within the contemplation of this invention to provide a hub in which the segmented tunnels are formed in the body of the hub and are completely surrounded by the material thereof. In this instance, the ring member 74 is defined by a finite length of material which is trained through the passages to define the looped members 75 as discussed above. Also in this embodiment, the free ends of the fiber member may be secured to the hub in any convenient fashion.

The cover 80 is scopped as at 80 to define hollow regions undercutting the cover 80 and communicating with the peripheral pockets 44.

Figure 2:
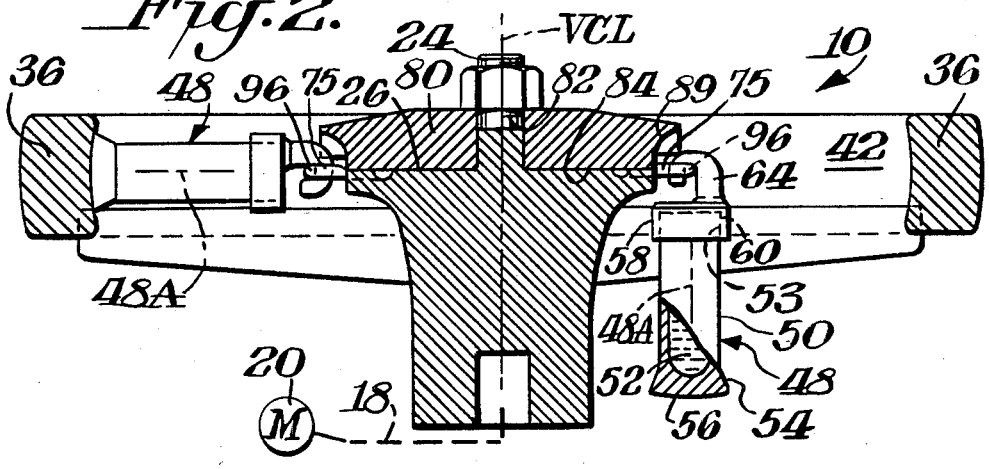
FIG. 2 is a side elevational view taken along section lines 2—2 of FIG. 1 illustrating in the right half thereof a sample container in the first position while in the left half thereof the sample container is shown in the second position with the looped member resiliently deformed radially outwardly to dispose the sample container in radially abutting force transmissive relationship with a stress confining enclosure.

In accordance with the first embodiment of this invention shown in FIGS. 1 and 2, the predetermined lengths of the ring 74 which project into the pockets 44 to define the looped members 75 have openings 76 sufficiently large to permit expeditious mounting and removal of the hook-like appurtenances 64 on the caps 58 of the sample containers 48. For a rotor in accordance with the first embodiment of the invention, the looped members 75 should generally take the form of relatively rigidly mounted projections. That is, the member 75 are sufficiently rigid so as not to change their orientation with respect to the axis VCL as the containers pivot from the first to the second position. With the rotor at rest, as seen in the right half of FIG. 2, the loop members 75 support the sample container 48 as it occupies the first position in which the axis 48A thereof lies substantially parallel to the vertical center line VCL of the rotor.

In the embodiment of the invention shown in FIGS. 4 through 6 the rigidity of the resilient ring 74 is selected such that the looped members 75 may be torsioned. In the second embodiment of the invention the hook-like appurtenance 64 of the sample container 48 tightly grasps the looped member 75 so that no relative motion therebetween is permitted. With one possible alternative case of this embodiment of the invention, as seen in FIGS. 4 and 5, while the container 48 occupies the first position the looped portions 75 (that is the exposed lengths of the ring 74) are torsioned and twisted approximately ninety degrees as at 92. As a second possible alternative case with this second embodiment of the invention the container 48 may grip the looped member 75 such that at the first position no twisting is imparted to the member 75.

The operation of a rotor in accordance with each embodiment of the invention may now be discussed.

Upon rotation of the rotor, as seen from FIG. 2, the sample container 48 responds to centrifugal force by pivoting with respect to the looped member 75 along the interface 96 defined by the inner surface of the hook 64 and the top and radially inner surfaces of the looped member 75 to move from the first to the second position in which the axis 48A of the container 48 is substantially perpendicular to the axis of rotation VCL. The scooped portions 89 provide clearance for the hook 64 of the container 48.

With the embodiment of the invention shown in FIGS. 4 through 6, rotation of the centrifuge hub 12 causes pivotal motion of the looped member 75' gripped by the sample container 48 from the first to the second position. Since in this embodiment of the invention the container 48 tightly grips the loop 75', in the first case discussed above this pivotal motion is accommodated by the untwisting of the torsioned portion 92 of the looped portions 75' of the ring 74'. In the event the container 48 engages the looped member 75' in the manner discussed in connection with the second alternative case, pivotal motion of the looped member 75' and the container 48 imparts a twisting motion of approximately ninety degres into the looped member 75'. In either case with this embodiment of the invention no relative rotation of the hook 64 with respect to the loop 75' occurs along the interface 96'. The member 75' may exhibit a rectangular corss-section such that is expeditiously received in the slot of the hook 64 (FIG. 6).

It should be noted that the rigidity of the ring 74 may be selected to produce a hybrid situation illustrated in FIG. 7. In this situation the loop 75'' is twisted partially (i.e., twisted significantly less than ninety degrees). In this situation, the container 48 loosely grips the loop 75'' as discussed in connection with the first embodiment. Thus, as the rotor spins the loop 75'' pivots to the horizontal (as in either case of the second embodiment) simultaneously as the container 48 pivots along the interface defined between the appurtenance 64 and the looped member 75''.

Whether configured in accordance with the first or second (or hybrid) embodiment, the container 48 reaches the second position in which its axis is perpendicular to the axis VCL.

As seen in FIG. 1 initially the spherical end 56 of the container 48 is spaced a predetermined radial clearance 100 from the inner surface of the stress confining enclosure. Once the container 48 reaches the second position increased rotational speed of the rotor is accommodated in any of the above-discussed embodiments of the invention by the resilient radially outward deformation of the looped portion 75, 75', 75'' of the ring 74 (as indicated by comparison of the resilient looped member at points 102 and 104 in FIG. 1) whereby the spherical radially outer surface 56 of the sample container 48 is brought into abutting force transmissive contact with the inner surface of the stress confining enclosure, as shown at 106.

Those skilled in the art having teachings of the present invention as hereinabove set forth may effect numerous modifications thereto. These modifications are to be construed as lying within the scope of the present invention as defined in the appended claims.

What is claimed is:

1. A swinging bucket centrifuge rotor for supporting a sample container having a hooked end through angular rotation from a first position in which the axis of the sample container lies substantially parallel to the rotor axis of rotation to a second position in which the axis of the container lies substantially perpendicularly thereto, the rotor comprising:

a central hub connectable to a source of motive energy; and, a looped member mounted to the hub, the looped member having an opening therein sized to receive the hooked end of the container and support the same for movement from the first to the second position, the opening defined by the looped member lying in a plane that defines a predetermined angle with respect to the axis of rotation when the container is in the second position.

2. The rotor of claim 1 wherein the looped member is resilient so that when in the second position increased centrifugal force is accommodated by the radially outwardly deflection of the looped member.

3. The rotor of claim 2 wherein the hub has a first and a second groove formed therein, each groove having a first end and a second end with one end of the first groove being circumferentially adjacent to one end of the second groove, the looped member being received within the grooves such that the looped member projects through the circumferentially adjacent ends of the first and second grooves.

4. The rotor of claim 3 wherein rotation of the rotor causes the sample container to pivot from the first to the second position on an interface defined between the hooked end of the sample container and the looped member.

5. The rotor of claim 3 wherein, in the first position, the sample container twists the looped member such that as the rotor rotates pivotal movement of the sample container to the second position is accommodated by untwisting of the looped member.

6. The rotor of claim 3 wherein, upon rotation of the rotor, pivotal movement of the sample container to the second position twists the looped member.

7. The rotor of claim 2 wherein rotation of the rotor causes the sample container to pivot from the first to the second position on an interface defined between the hooked end of the sample container and the looped member.

8. The rotor of claim 7 wherein, in the first position, the sample container twists the looped member such that as the rotor rotates pivotal movement of the sample container to the second position is accomodated by untwisting of the looped member.

9. The rotor of claim 7 wherein, upon rotation of the rotor, pivotal movement of the sample container to the second position twists the looped member.

10. The rotor of claim 2 wherein, in the first position, the sample container twists the looped member such that as the rotor rotates pivotal movement of the sample container to the second position is accommodated by untwisting of the looped member.

11. The rotor of claim 10 wherein the pivotal movement of each sample container occurs without relative movement between the sample container and the looped member on which it is received.

12. The rotor of claim 2 wherein, upon rotation of the rotor, pivotal movement of the sample container to the second position twists the looped member.

13. The rotor of claim 12 wherein the pivotal movement of each sample container occurs without relative movement between the sample container and the looped member on which it is received.

14. The rotor of claim 1 wherein the looped member is defined by a resilient ring mounted to the rotor so that when in the second position increased centrifugal force is accommodated by the radially outwardly deflection of the looped member.

15. The rotor of claim 14 wherein the rotor has a predetermined number of pockets each sized to receive a sample container therein and wherein the hub has the same predetermined number of grooves formed therein, each groove having a first end and a second end with the first end of each groove being circumferentially adjacent to the second end of the circumferentially adjacent groove, the resilient ring being received within the grooves such that predetermined portions of the resilient ring project from the hub through the adjacent circumferential ends of circumferentially adjacent grooves to define the predetermined number of loops each one of which projects into a pocket and is adapted to receive the hooked end of a sample container.

16. The rotor of claim 15 wherein the rotor causes each sample container to pivot from the first to the second position on an interface defined between the hooked end of a sample container and the loop on which it is received.

17. The rotor of claim 15 wherein, in the first position, the sample container twists the looped member on which it is received such that as the rotor rotates pivotal movement of the sample container to the second position is accommodated by untwisting of the looped member.

18. The rotor of claim 17 wherein the pivotal movement of each sample container occurs without relative movement between the sample container and the looped member on which it is received.

19. The rotor of claim 15 wherein, upon rotation of the rotor, pivotal movement of each sample container to the second position twists the looped member on which it is received.

20. The rotor of claim 19 wherein the pivotal movement of each sample container occurs without relative movement between the sample container and the looped member on which it is received.

21. The rotor of claim 14 wherein rotation of the rotor causes the sample container to pivot from the first to the second position on an interface defined between the hooked end of the sample container and the looped member.

22. The rotor of claim 21 wherein, in the first position, the sample container twists the looped member such that as the rotor rotates pivotal movement of the sample container to the second position is accomodated by untwisting of the looped member.

23. The rotor of claim 21 wherein, upon rotation of the rotor, pivotal movement of the sample container to the second position twists the looped member.

24. The rotor of claim 14 wherein, in the first position, the sample container twists the looped member such that as the rotor rotates pivotal movement of the sample container to the second position is accommodated by untwisting of the looped member.

25. The rotor of claim 24 wherein the pivotal movement of the sample container occurs without relative movement between the sample container and the looped member.

26. The rotor of claim 14 wherein, upon rotation of the rotor, pivotal movement of the sample container to the second position twists the looped member.

27. The rotor of claim 26 wherein the pivotal movement of each sample container occurs without relative movement between the sample container and the looped member on which it is received.

28. The rotor of claim 1 wherein the hub has a first and a second groove formed therein, each groove having a first end and a second end with one end of the first groove being circumferentially adjacent to one end of the second groove, the looped member being received within the grooves such that the looped member projects through the circumferentially adjacent ends of the first and second grooves.

29. The rotor of claim 28 wherein rotation of the rotor causes the sample container to pivot from the first to the second position on an interface defined between the hooked end of the sample container and the looped member.

30. The rotor of claim 28 wherein, in the first position, the sample container twists the looped member such that as the rotor rotates pivotal movement of the sample container to the second position is accommodated by untwisting of the looped member.

31. The rotor of claim 28 wherein, upon rotation of the rotor, pivotal movement of the sample container to the second position twists the looped member.

32. The rotor of claim 1 wherein rotation of the rotor causes the sample container to pivot from the first to the second position on an interface defined between the hooked end of the sample container and the looped member.

33. The rotor of claim 32 wherein, in the first position, the sample container twists the looped member such that as the rotor rotates pivotal movement of the sample container to the second position is accomodated by untwisting of the looped member.

34. The rotor of claim 32 wherein, upon rotation of the rotor, pivotal movement of the sample container to the second position twists the looped member.

35. The rotor of claim 1 wherein, in the first position, the sample container twists the looped member such that as the rotor rotates pivotal movement of the sample container to the second position is accommodated by untwisting of the looped member.

36. The rotor of claim 35 wherein the pivotal movement of the sample container occurs without relative movement between the sample container and the looped member.

37. The rotor of claim 1 wherein, upon rotation of the rotor, pivotal movement of the sample container to the second position twists the looped member.

38. The rotor of claim 37 wherein the pivotal movement of the sample container occurs without relative movement between the sample container and the looped member.

* * * * *